United States Patent [19]

Hewitt et al.

[11] 4,020,814

[45] May 3, 1977

[54] DIESEL ENGINE CONTROL MEANS

[76] Inventors: John T. Hewitt, 1021 Camino Real, Redondo Beach, Calif. 90277; Peter B. J. Holtrop, 1500 Cyrene Drive, Carson, Calif. 90746

[22] Filed: May 30, 1975

[21] Appl. No.: 582,097

[52] U.S. Cl. ..... 123/140 MC; 123/198 DB

[51] Int. Cl.[2] ..... F02D 1/04

[58] Field of Search ..... 123/140 MC, 198 DB; 60/277, 285; 251/139

[56] References Cited

UNITED STATES PATENTS

| | | | |
|---|---|---|---|
| 2,546,325 | 3/1951 | Wasserlein | 251/139 |
| 2,616,452 | 11/1952 | Clay et al. | 251/139 |
| 2,734,496 | 2/1956 | Hammond | 123/198 DB |
| 3,153,426 | 10/1964 | Milster | 251/139 |
| 3,472,068 | 10/1969 | List et al. | 123/198 DB |
| 3,592,228 | 7/1971 | Kukuminato et al. | 251/139 |
| 3,596,640 | 8/1971 | Bloomfield | 123/198 DB |
| 3,605,711 | 9/1971 | Fuso | 123/140 MC |
| 3,738,108 | 6/1973 | Goto et al. | 60/285 |
| 3,851,469 | 12/1974 | Eichler et al. | 60/277 |

*Primary Examiner*—C. J. Husar
*Assistant Examiner*—David N. Reynolds
*Attorney, Agent, or Firm*—Fulwider, Patton, Rieber, Lee & Utecht

[57] ABSTRACT

There is disclosed automatic means for limiting the operating temperature of an internal combustion engine that includes a pyrometer to sense the exhaust gas temperature from the engine and generate a signal therefrom, a temperature controller having an adjustable, maximum set point temperature to receive the signal from the pyrometer and to generate a control signal which is applied to a control valve in the fuel system to the engine or to electromechanical means to limit the supply of fuel or governor control in response to a sensed exhaust gas temperature which exceeds the preselected, maximum set point temperature. The invention can be particularly applied to a diesel engine by installing a flow control valve in the diesel engine fuel system operative to cycle the valve when the exhaust gas temperature exceeds the preselected maximum, set point temperature.

10 Claims, 5 Drawing Figures

DIESEL ENGINE CONTROL MEANS

BACKGROUND OF THE INVENTION

1. Field of Invention

This invention relates to internal combustion engine operation and, in particular, to a automatic control system to prevent operation of the engine at excessive temperatures.

2. Brief Statement of the Prior Art

A common cause of damage and excessive wear of internal combustion engine reuslts from excessive combustion temperatures in the engine. The operational temperature of the engine can repidly exceed a safe operational limit by improper operation where the engine is overloaded at any speed, requiring overthrottling and an excessive rate of fuel injection. This often occurs when driving a dieselpowered vehicle into unnoticed head or side winds or climbing unnoticed grades, or failing to notice changes in ambient pressure resulting from altitude changes or high ambient temperatures. Additionally, malfunctions in the engine and its accessory equipment such as in the fuel supply system or fuel injectors, improper timing, turbocharger, restricted air cleaner, leak in a cross over tube, etc. can also cause an improper supply of fuel to the engine and result in a excessive operational temperature of the engine.

When the temperature of an engine exceeds a safe operational temperature, even for periods of relatively short duration, the damage that can be expected includes burned valves, head gasket failures, engine block distortion, cracked manifold and cylinder heads, burning and scoring of pistons, carbon deposits behind piston rings, piston ring failure with resultant high oil consumption and blow by, lubrication oil dilution, and cracks in the turocharger unit.

It is generally recognized that the engine temperature of a diesel engine is critically affected by the aforementioned operational or equipment defects. As a result, many diesel engines are provided with pyrometers to monitor the exhaust gas temperature of the engine. Some of the pyrometers have been equipped with visual or audible warning signal generators to alert the operator when the exhaust gas temperature exceeds a predetermined, safe operational level. These devices are not entirely satisfactory since the warning signals can be inadvertently or deliberately ignored during operation of the engine. Since operations of relatively short durations at excessive temperatures can have disastrous effects on the engine, any failure to take corrective steps immediately upon indication of an excessive exhaust gas temperature, can result in an expensive and time consuming engine overhaul.

BRIEF STATEMENT OF THE INVENTION

This invention comprises an automatic temperature control system for use on an internal combustion eninge. The invention has particular significance and advantages when applied to a diesel engine. The invention comprises an engine exhaust gas temperature sensing pyrometer that generates a signal proportional to the engine exhaust gas temperature, control means which receives the generated signal, compares the signal to a preselected reference which corresponds to a maximum safe operational engine temperature and generates a control signal when the sensed temperature signal exceeds the preselected signal level, and control means operative on the engine governor or a control valve means in the fuel supply system to vary the fuel flow rate to the engine in response to the control signal, decreasing the fuel flow rate to the engine.

The control system of the invention can be employed on a diesel engine by installing a control valve in the engines's fuel supply system that is responsive to a control signal to divert fuel from the fuel supply to the engine, bypassing the diverted fuel around the high pressure fuel pump. The system can also be adapted for use on diesel engines by use of a electromechanical solonoid responsive to a control signal to effect a change or shift in the mechanical linkages of the engine governor to the particular fuel metering and injecting means of the engine. Turbocharged engines having an aneroid fuel ratio control can be simply modified by installing a control valve to vent air pressure from the aneroid fuel ratio control and thereby effect control of the fuel supply to the engine.

BRIEF DESCRIPTION OF THE DRAWINGS

The invention is illustrated in the drawings of which.

DESCRIPTION OF THE PREFERRED EMBODIMENTS

Figure 1:
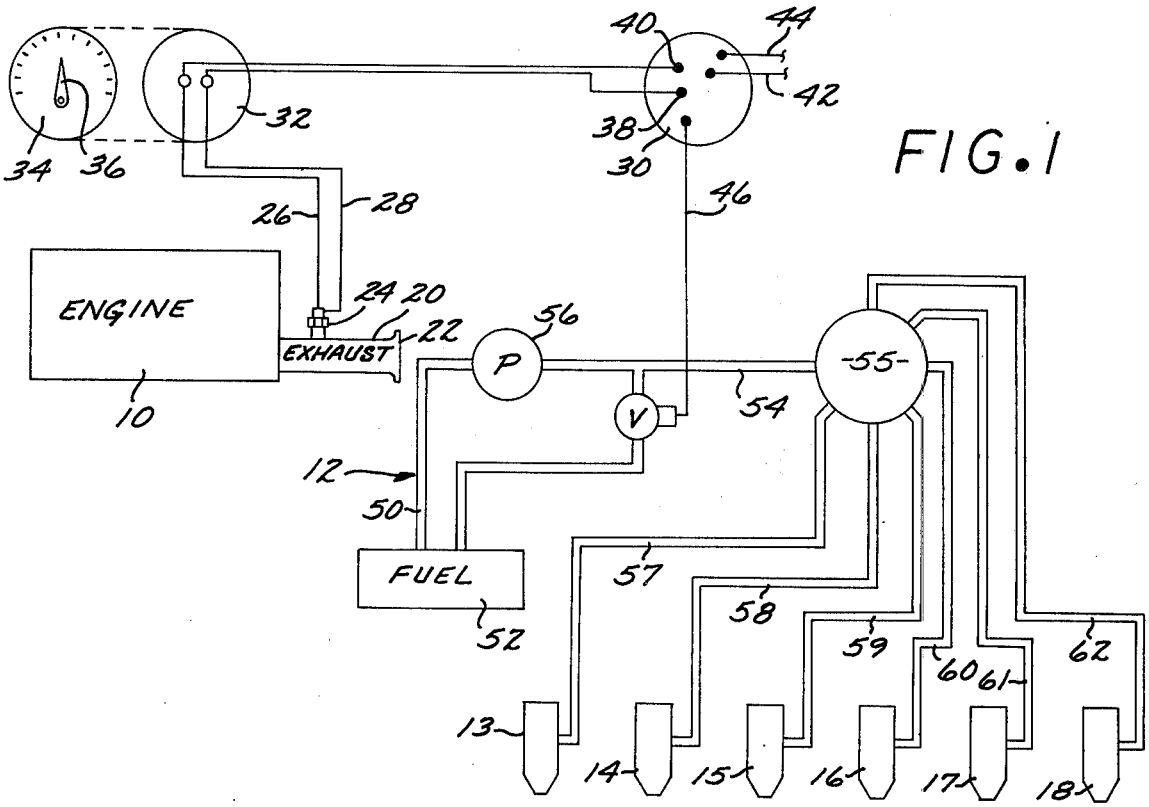
FIG. 1 illustrates the invention with a diesel system having a single pump and high pressure fuel distributor.

Referring now to FIG. 1, there is illustrated a diesel engine 10 which has a fuel supply system generally indicated at 12 to supply fuel under high pressure to each of a plurality of fuel injectors 13–18, one for each of the multiple cylinders of the engine, which are located in the cylinder head of the engine. The engine 10 is a conventional diesel engine which normally operates at a compression ratio from 13.5:1 to about 18:1 and which can be supercharged, turbocharged, or naturally aspirated. The compression ratio of the engine is sufficient to raise the air temperature in the cylinder sufficiently to ignite the fuel as it is injected into the cylinder from the individual injectors 13–18. The engine can have from 2 or more cylinders arranged in-line or in parallel banks as in a V-6, V-8 or V-12 configuration.

The engine is provided with an exhaust gas manifold, generally indicated at 20, which can be a single manifold for in-line engines or can be two, parallel exhaust gas manifolds for V-cylinder confingurations. The exhaust gas manifolds are usually of cast iron and have a flange fitting 22 for attachment of steel exhaust tubes and the like.

The invention is applied to these engines by fitting the exhaust gas manifold with pyrometer means 24 that is preferably located in the exhaust gas manifold to obtain reliable temperature indications. The pyrometer means is typically a thermocouple which is installed by tapping a threaded bore in the exhaust manifold at the appropriate location. The thermocouple wires are connected to parallel lead wires 26 and 28 which extend to control means 30.

Preferably, leads 26 and 28 are connected to a temperature display meter 32 having a display face 34 that is provided with a dial bearing indicia calibrated in temperature, typically in degrees Fahrenheit, and a pointer 36 to indicate to the operator the exhaust gas temperature that is sensed by pyrometer means 24.

The thermocouple, when used as the pyrometer means, is operative to generate an analog direct current (D.C) millivolt signal reflective of the exhaust gas temperature. This D.C. signal is applied to the input terminals 38 and 40 of control means 30. The control means 30 is also provided with a supply of battery voltage by lead wires 42 and 44.

Control means 30 is a solid state controller having an operational amplifier receiving the input voltage signal from the thermocouple and referenced to generate a control signal when the sensed temperature exceeds a predetermined value. The thermocouple is connected between the wiper of a potentiometer and the operational amplifier which is driven in a operational mode by receiving reference lead input from a voltage divider. The potentiometer is adjustable to provide adjustment of the maximum safe operational temperature to any desired safe temperature of operation for the particular engine. This temperature is generally from 500° to about 1800° F. for internal combustion engines and, typically for diesel engines, from 500° to 1350° F. The operational amplifier output is connected to a first driver through a ground loop isolating optical coupler. The first driver is connected to an audio alarm and across a slow charge, fast discharge time delay to a second driver that produces a control signal to lead 46.

The control signal generated by control means 30 is applied through conducting lead 46 to the normally closed control valve 48 that is positioned in the main fuel line 54 of the fuel supply system 12. The fuel supply system 12 comprises a fuel reservoir 52 to supply fuel through line 50 at low pressure to the pump and metering unit 56.

The pump and metering unit 56 discharges fuel at high pressure through line 54 to a fuel distributor 55 which directs the flow through high pressure lines 57–62 ot injectors 13–18 for each of the multiple cylinders of the engine. The fuel is pressured to adequate pressure for injection into the engine, typically from 2200 to about 2800 p.s.i.g. and is delivered to the injectors 13–18 in a timed fashion controlled by the distributor 55 that operates in synchronism with engine 10. The high pressure fuel enters each injector and is applied to an internal injection valve which is spring-biased into a closed position. The high pressure of the fuel supplied to the injector is sufficient to overcome the spring force on the injector valve, forcing the valve open and permitting the fuel to be injected into the cylinder at the proper time.

Figure 5:
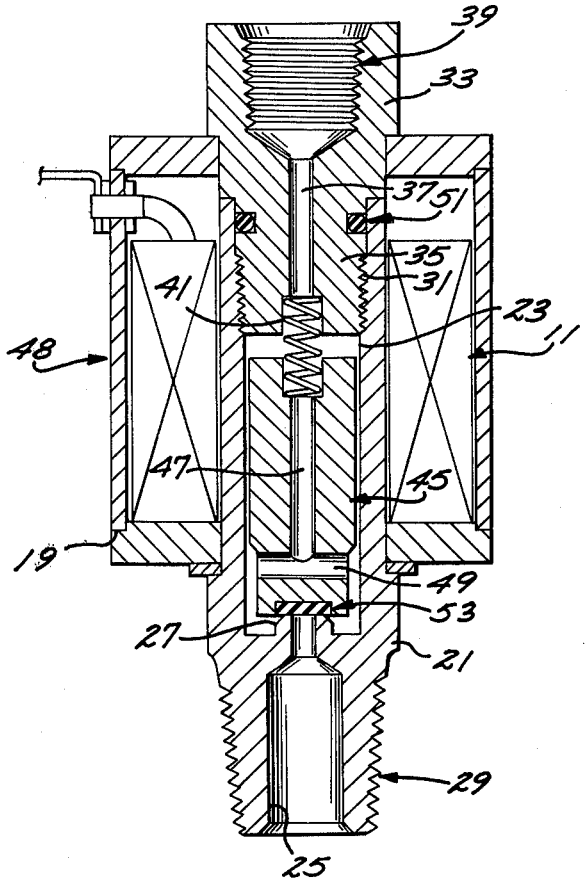
FIG. 5 illustrates a control valve for use in the invention.

Control valve 48 of the control system of this invention can be positioned in the high pressure main fuel line 54 that extends from the fuel supply pump 56 to the distributor 55. As so installed, valve 48 can be a conventional, electrical solenoid valve operative on the available D.C. voltage supply of the engine, typically 12 or 24 volts D.C. The preferred valve 48 for this installation is shown in FIG. 5 and is a normally closed control valve. The valve 48 comprises a tubular housing 21 having a central bore 23 and a counter bore 25 with a small diameter orifice and valve seat 27 therebetween. One end of housing 21 bears external threads 29 for attachment in the fuel system and the opposite end bears internal threads 31 to receive a replacable fitting 33. Fitting 33 has an externally threaded neck 35 for removable mounting in housing 21, a through passageway 37 of a preselected diameter, and an internally threaded counter bore 39 for attachment of a high pressure fuel line from line 54 of the fuel system shown in FIG. 1. The inboard end of fitting 33 has a counter bore 41 to provide retention for a compression spring 43 that biases closure member 45 into a closed position against seat 27. Fluid communication through the valve extends through central bore 47 and intersecting bore 49 of closure member 45. The valve housing is sealed by O-ring 51 and a resilient (Hycar) disc 53 carried by closure member 45.

The valve housing 21 is surrounded by an electrical coil 11 coupled to lead 46 and contained within jacket 19. This coil effects movement of closure member 45 as in a conventional solonoid valve. The diameter of the passageway 37 is preselected for the particular engine installation to permit a predetermined amount of fuel to be bypassed about the high pressure fuel pump. The valve closure member 45 moves into a full open position in response to a control signal from the control unit 30 and the passageway is sized to divert from 8 to about 20 percent, preferably from 10 to about 15 percent of the fuel about the high pressure pump.

Figure 2:
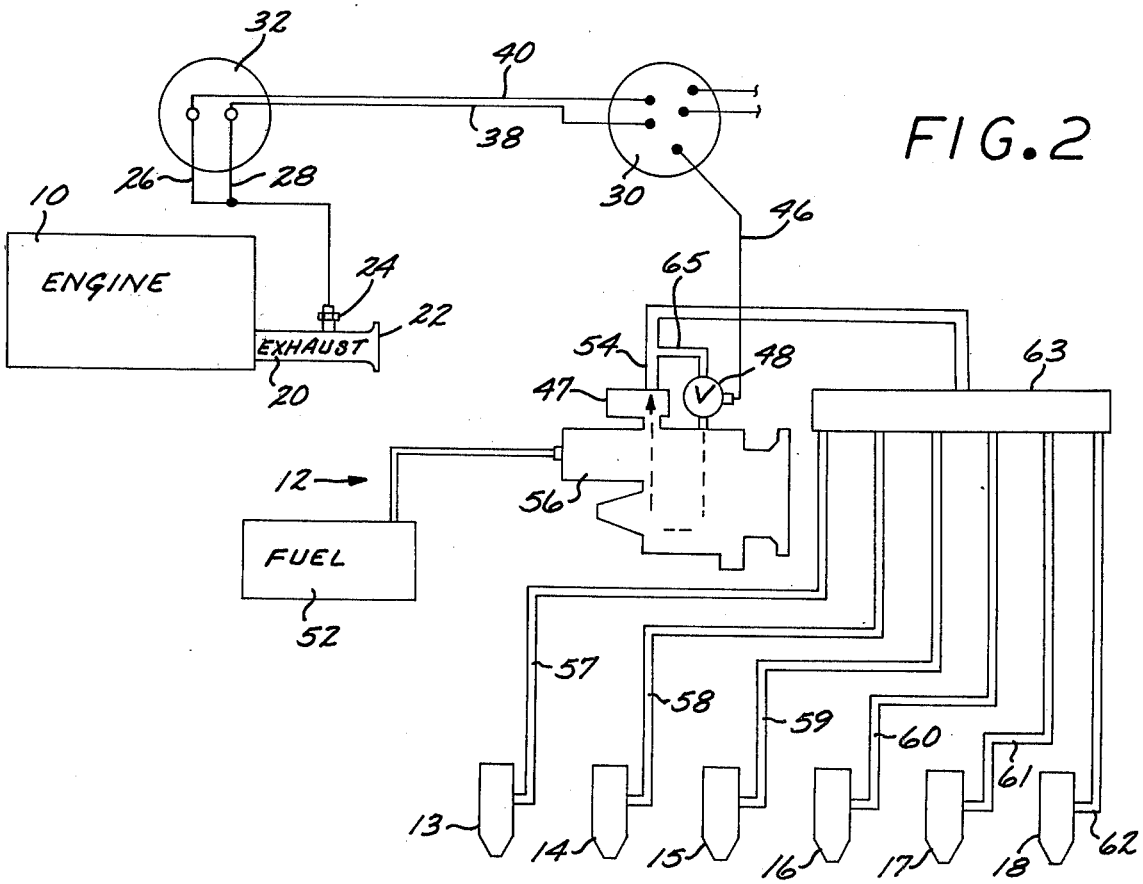
FIG. 2 illustrates the invention as applied to a diesel fuel system having individual metering injectors.

Referring to FIG. 2, the fuel supply systems of some engines have the pump 56 and distributor 55 combined in a single housing. The invention can be applied to such engines by providing a port in the housing on the high pressure side of the pump and by installing valve 48 in the port to bypass fuel from the pump to the fuel tank in response to the control signal.

In FIG. 2, the invention is shown applied to a diesel engine having a somewhat different fuel supply system from that described in FIG. 1. As there illustrated, the diesel engine 10, which is similar to that previously described, has an exhaust manifold 20 with a flange fitting 22 for attachment of tubular exhaust lines. The manifold is fitted with pyrometer means 24 and parallel leads 26 and 28 extend to temperature indicator 32 which, as previously described, has a display face calibrated with indicia reflective of exhaust gas temperatures and a pointer responsive to the analog signal developed by pyrometer means 24.

The analog signal is also applied to input terminals 38 and 40 of control unit 30 which is identical to that described with reference to FIG. 1. The control signal generated by control unit 30 is applied through lead 46 to a control valve 48 which is located in the fuel supply system of the engine, generally indicated at 12. This fuel supply system 12 comprises a fuel storage reservoir 52 to supply fuel at low pressure to the high pressure fuel pump 56.

High pressure pump 56 is in driven connection to the engine 10 and is operative to supply high pressure fuel through line 54 to a high pressure fuel header 63 to deliver high pressure fuel through high pressure fuel lines 57–62 to each of the multiple injectors 13–18 mounted in the engine cylinder head to discharge into the individual cylinders of engine 10.

The high pressure fuel pump 56 typically has a single plunger which meters and pressures the fuel for all of the individual cylinders of the engine. The pump is provided with a governor control, internally of the pump housing, and a mechanical linkage to the throttle of the engine whereby the length of stroke and hence, amount of fuel delivered through high pressure line 54, is varied in response to the movement from the throttle linkage and/or from the internal governor.

Typically, the high pressure pump bears a solenoid valve 47 discharging into line 54. The control valve 48 of the invention is connected in the fuel supply system 12 by installing a bypass line 65 from the discharge of the solenoid valve 48 to an intake port on the housing of the fuel pump 56. Control valve 48 is preferably an electrical solenoid valve that is normally closed, i.e., which has its valve member spring-biased into a closed position. The valve should be capable of functioning under pressure up to 2500 p.s.i.g. to be suitable for use in the high pressure supply system typically encountered in fuel supplies for diesel engines. The electrical solenoid of the valve is operative to urge the valve into an open position responsive to the control signal generated by control unit 30 and applied to the solenoid by conducting lead 46 in the manner previously described in regard to FIG. 5. The opening of valve 48 results in diversion of fuel through bypass line 65 to pump 56 as shown by the broken arrowhead line in FIG. 2.

Figure 3:
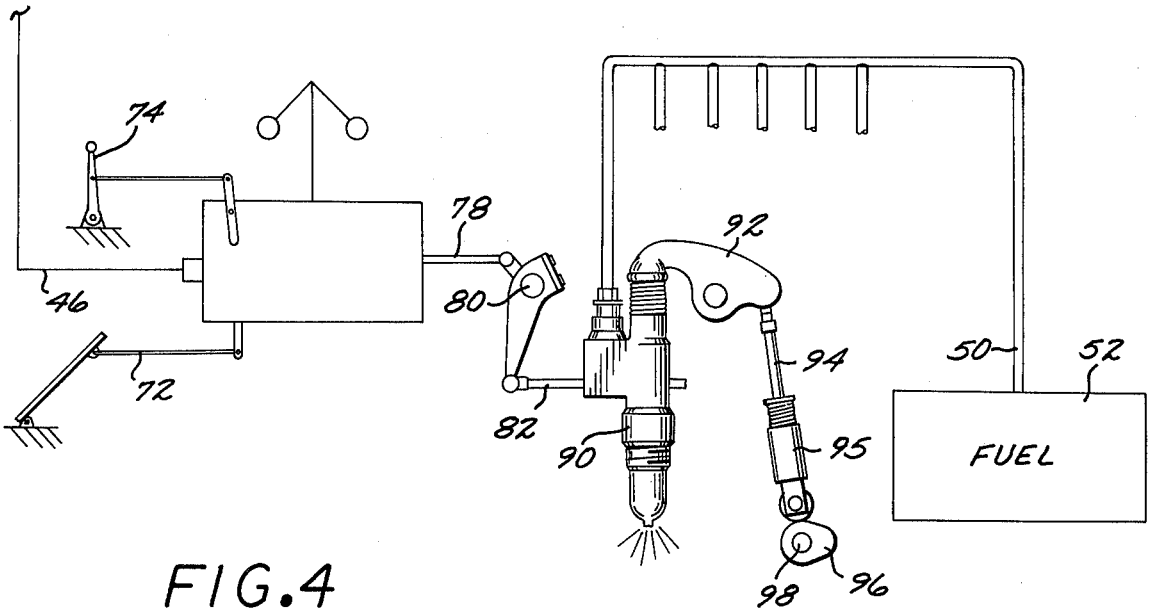
FIG. 3 illustrates the invention with a unit injector system.

Referring to FIG. 3, there is illustrated a unit injector diesel fuel system. In this system, the exhaust gas thermocouple, indicator and pyrometer control means are used as previously described. The fuel supply to the engine is from reservoir 52 through line 50 to each of a plurality of unit injectors 90, provided one for each cylinder. The low pressure fuel is raised to a high pressure by a plunger pump driven by a rocker arm 92 actuated by a lift rod 94 that bears on a cam follower 95 which rides on cam 96 on camshaft 98 of the engine. Lead 46 from the control means is extended to a conventional limiting speed mechanical governor 70 which also receives mechanical inputs from throttle linkage 72 and from shut down lever 74. The governor 70 has a double flyweight mechanical governor symbolically shown at 76. The temperature control lead 46 extends to a solenoid and, together with the mechanical and governor linkages effects movement of link arm 78 to control tube lever 80 of each injector for each of the engine cylinders. Lever 80 repositions fuel rack 82 to provide a variable flow orifice adjustable in area to increase in response to depressing of the accelerator pedal or decrease in response to rotational speed of flyweight governor 76 or closing of shut down lever 74. In accordance with this invention, the rack is also moved to decrease the orifice area in response to an excessive sensed exhaust temperature reflected by application of a control signal through lead 46.

Figure 4:
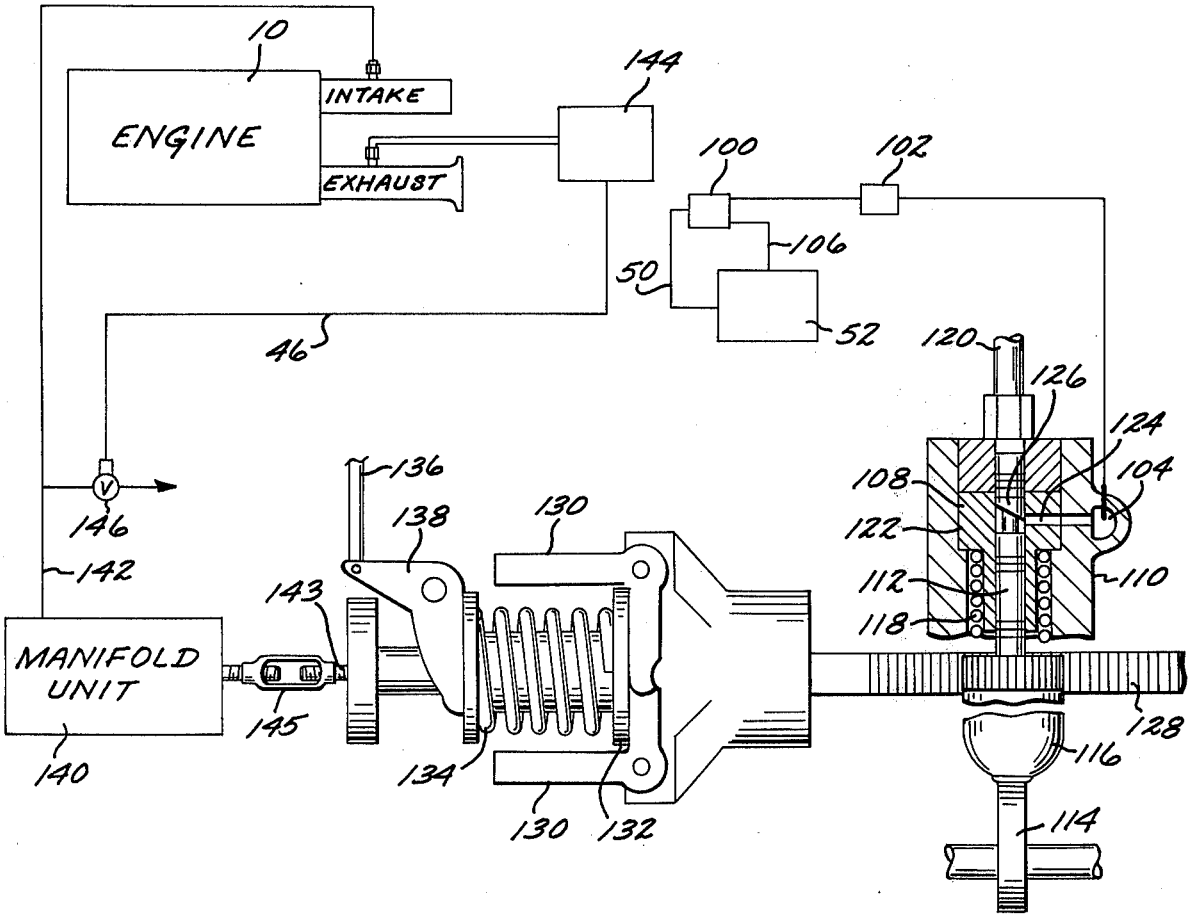
FIG. 4 illustrates application of the invention with a diesel engine having a multiple pump and fuel metering unit.

The invention is shown in FIG. 4 as applied to a diesel system having separate metering valves and injectors for each cylinder. The fuel system comprises reservoir 52, supply line 50, a transfer pump 100, filter 102 and injection manifold 104. Commonly, transfer pump 100 supplies an excess flow of fuel which is bypassed through line 106 to reservoir 52.

FIG. 4 shows one of the plurality of fuel metering valve 108 which are provided, one per cylinder, and are conventionally housed in a single pump housing 110. The pump plunger 112 is driven by cam 114 of engine 10 through lifters 116 and held against the cam 114 by spring 118. The amount of fuel delivered to injection line 120 by the pump plunger depends on the rotational position of the plunger in barrel 122 since the timing of the opening and closing of fuel supply port 124 is controlled by the angular position of the helical scroll 126 of plunger 112. With the scroll 126 oriented as illustrated, maximum fuel is delivered since the port 124 remains blocked through the major distance of travel of plunger 112. When the scroll is rotated to open port 124 earlier in travel of plunger 112, high pressure fuel from above plunger 112 is vented beneath the helical scroll into port 124.

The position of helical scrol 126 is controlled by reciprocation of rack 128 that is coupled to a mechanical governor having double flyweights 130 which move retainer 132 against spring 134 to withdraw rack 128 and decrease the high pressure fuel displacement of plunger 112. The throttle linkage 136 is linked to rack 128 by lever 138.

The position of rack 128 is also controlled in response to the intake manifold pressure by manifold unit 140 which is an aneroid unit that is connected to the intake manifold by conduit 142 so that an increase in manifold pressure such as resulting from turbocharging will extend rack 128 and increase the fuel delivered by plunger 112.

This invention is applied to the aforedescribed system by installing thermocouple 24 and control system 144 which includes pyrometer 32 and control unit 30, previously described. Lead 46 is connected to solenoid valve 146 which vents line 142 to the atmosphere in response to a control signal from control system 144 and thereby reduces the pressure applied to aneroid manifold unit 140 and withdraws rack 128. In this manner, the control signal from control unit 30 is applied to the governor control of the engine to effect engine control. To provide adjustability of the control for various engines, an adjustable link such as nut 145 can be provided between control rod 143 and the output rod of the aneroid unit 140.

The FIG. 4 embodiment can also be applied to naturally aspirated engines. In this application, the manifold unit 140 and solenoid valve 146 can be replaced with a mechanical actuator such as an electromechanical solonoid or an air operated cylinder operative to urge rod 143 in response to a control signal similarly to the movement made by the manifold pressure regulator 140 described in FIG. 4.

The invention as thus described can be seen to comprise means for the automatic regulation of the fuel supply to a diesel engine in response to engine exhaust gas temperature. The control system of the invention can be readily installed on a diesel engine. The system only requires the tapping of a threaded bore in the exhaust mainfold, mounting of the pyrometer means therein, and the installation of a control valve in an appropriate location in the fuel supply line. The instruments such as the visual temperature indicator and the control unit can be remotely mounted on an instrument panel of a fixed or mobile diesel engine. Since the system does not rely upon mechanical interconnection between the remote units and the pyrometer or control valve, ease of installation is assured.

When installed, the system insures against improper operation of the diesel engine that may result from incorrect operator practices such as overthrottling of the engine or from defects in the fuel or air supply system which could lead to excessive engine operational temperatures. The device does not rely upon the operator intervention to make the necessary corrections that would prevent the engine temperature from reaching an unsafe value. Instead, the control system provides for the automatic regulation of the fuel supply system by providing an automatic means for limitation of fuel supply to the engine when the exhaust gas temperature reaches the preselected maximum that is reflective of the maximum safe operational temperature for the engine. Because the control is effected automatically, it cannot be inadvertently or intentionally ignored and, accordingly operation of the engine, even for short durations, at excessive temperatures is thereby prevented.

The invention has been described with reference to the presently preferred and illustrated embodiments thereof. It is not intended that the invention be unduly limited or restricted by this disclosure of the preferred embodiments. Instead, it is intended that the invention be defined by the means and their obvious equivalents set forth in the following claims.

What is claimed:

1. A diesel engine having multiple cylinders and fuel supply means comprising a fuel supply line, fuel pump means to produce a high pressure supply of fuel and to direct said high pressured fuel to cylinder injectors discharging directly into the multiple engine cylinders in a timed and sequential manner, and excess temperature control means having governor or fuel supply means to control the engine operation which comprises:

an engine exhaust gas temperature sensing means positioned in the engine exhaust line to generate a sensed signal responsive to the temperature of exhaust gas discharged from said engine;

control means to receive said sensed signal, compare said signal to a preset signal level corresponding to a maximum safe operational engine temperature, and to generate a control signal therefrom when said sensed signal exceeds said preset signal level;

excess temperature control means which comprises a bypass fuel line about said fuel pump means and a normally closed solonoid valve in said bypass fuel line operative in response to said control signal to divert a predetermined amount of fuel from supply to said cylinder injectors of said engine; and means interconnecting said control means to said excess temperature control means whereby said control signal is operative to effect control of said engine in response to said control signal.

2. The engine and control of claim 1 wherein said temperature sensing means is a thermocouple positioned in the exhaust gas manifold of said engine and operative to generate a direct current sensed signal.

3. The engine and control of claim 2 wherein said solonoid valve means comprises a normally-closed, direct current solenoid valve.

4. The engine and control of claim 3 wherein said control means generates a direct current control signal including adjustment means carried by said control means whereby the value of said preset signal level can be fixedly adjusted.

5. The diesel engine control of claim 2 as applied to a diesel engine having a fuel supply system includling a high pressure fuel pump, and a high pressure distributor to direct pressured fuel received from said pressure pump to the multiple engine cylinders in a timed and sequential manner and wherein said solonoid valve is positioned in a bypass line about said high pressure pump.

6. The engine and control of claim 3 wherein said solonoid valve means has a tubular body received within the windings of a solonoid coil, a distal port communicating with an internal valve seat, an end fitting removably attached to the opposite end thereof and having a through passageway of a preselected diameter communicating with said tubular body downstream of said internal valve seat and a valve closure member slidably received within said tubular body, spring means between the inboard end of said end fitting and said closure member biasing the latter into a closed position.

7. The engine and control of claim 6 wherein said tubular body bears external threads on its distal port and, on its opposite end, bears internal threads for the removable attachment of said end fitting.

8. The engine and control of claim 7 wherein said valve closure member is a cylindrical plug member having a valve seat end of reduced diameter with a central through passageway which intersects a transverse bore through said valve seat end of reduced diameter.

9. The engine and control of claim 8 wherein the valve seat end of said valve closure member bears a replaceable resilient disk for engagement by said internal valve seat.

10. The engine and control of claim 1 wherein said fuel pump means has a pump housing including intake port means communicating with the intake side of said pump and said bypass line and said solonoid valve are connected between the discharge of said pump means and said intake port means.

* * * * *